US005785132A

United States Patent [19]

Richardson et al.

[11] Patent Number: 5,785,132

[45] Date of Patent: Jul. 28, 1998

[54] BACKUP TOOL AND METHOD FOR PREVENTING ROTATION OF A DRILL STRING

[76] Inventors: Allan S. Richardson, 71 Woodacres Dr., SW., Calgary, AB, Canada, T2W 4V8; Monte N. Wright, 205 McEwan Valley Rd., NW., Calgary, AB, Canada, T3K 357

[21] Appl. No.: 608,727

[22] Filed: Feb. 29, 1996

[51] Int. Cl.[6] ..... B25B 13/50

[52] U.S. Cl. ..... 175/57; 81/57.16; 81/57.34

[58] Field of Search ..... 175/51, 52, 161, 175/57; 81/57.16, 57.34

[56] References Cited

U.S. PATENT DOCUMENTS

| | | | |
|---|---|---|---|
| 2,453,369 | 11/1948 | Grable et al. | 81/57.34 |
| 2,690,847 | 10/1954 | Crookston | 414/22.51 |
| 2,746,329 | 5/1956 | Paget | 81/57.17 |
| 2,850,929 | 9/1958 | Crookston et al. | 81/57.19 |
| 2,928,301 | 3/1960 | Beeman et al. | 81/57.19 |
| 3,392,609 | 7/1968 | Bartos | 81/57.19 |
| 3,680,412 | 8/1972 | Mayer et al. | 81/57.34 |
| 3,808,916 | 5/1974 | Porter et al. | 81/57.19 |
| 3,921,473 | 11/1975 | Boyadjieff et al. | 81/57.34 |
| 4,057,887 | 11/1977 | Jones et al. | 29/240 |
| 4,082,017 | 4/1978 | Eckel | 81/57.16 |
| 4,128,135 | 12/1978 | Mitchhart et al. | 175/52 |
| 4,425,827 | 1/1984 | Wells | 81/57.19 |
| 4,446,761 | 5/1984 | Boyadjieff et al. | 81/57.19 |
| 4,478,111 | 10/1984 | Wells et al. | 81/57.19 |
| 4,515,045 | 5/1985 | Gnatchenko et al. | 81/429 |
| 4,545,269 | 10/1985 | Lemaire et al. | 81/57.34 |
| 4,585,079 | 4/1986 | Lemaire et al. | 173/164 |
| 4,590,823 | 5/1986 | Neves et al. | 81/57.14 |
| 4,649,777 | 3/1987 | Buck | 81/57.34 |
| 4,712,284 | 12/1987 | Coyle Sr. et al. | 29/240 |
| 4,765,401 | 8/1988 | Boyadjieff | 166/77.53 |
| 4,774,861 | 10/1988 | Hamilton et al. | 81/57.33 |
| 4,843,924 | 7/1989 | Hauk | 81/57.2 |
| 5,054,550 | 10/1991 | Hodge | 166/78.1 |
| 5,351,582 | 10/1994 | Snyder et al. | 81/57.17 |

*Primary Examiner*—David J. Bagnell

[57] ABSTRACT

A backup tool for engaging a drill pipe body having elongated jaws such that the pressure exerted by the jaws on the drill pipe body is sufficiently distributed to not damage the drill pipe body.

3 Claims, 4 Drawing Sheets

BACKUP TOOL AND METHOD FOR PREVENTING ROTATION OF A DRILL STRING

BACKGROUND OF THE INVENTION

Subterranean drilling typically involves rotating a drill bit at the distal end of a string of drill pipe. The rotating bit works its way through underground formations opening a path for the drill pipe that follows. The force relating to the drill bit is generated at a drill rig typically located at ground level or some distance above sea level. The rotational force is transmitted to the bit by the drill pipe string. The drill pipe string is merely sections of drilling pipe connected together. As the drill bit progresses, additional sections of drill pipe are added to the drill string.

New sections of drill pipe are added to the string by stopping the rotational movement of the string and threadedly engaging the new section of drill pipe with the proximal end of the drill string. The diameters of the drill pipe ends are enlarged. The ends are adapted for the threaded engagement of one pipe section to another. The enlarged ends also provide a convenient and ruggidized engagement surface for applying rotational force to the drill pipe to effect the threaded engagement of the end of the drill pipe section with the proximal end of the drill string and for rotating the drill string.

Generally, the drill pipe string is advanced as far as practical before a new drill pipe section is added to the string. Thus, typically, the proximal end of the drill string extends at most a few feet above the drilling platform floor. Workers can manually manipulate the drill pipe section relative to the proximal end of the drill string. The enlarged ends of the drill pipe section and the enlarged end of the proximal end of the drill string are accessible and appropriate tools can be applied to the enlarged pipe ends to rotate the pipe section into the pipe string and to hold the pipe string stationary relative to the rotating pipe section.

For example, a tool often referred to as a "backup" may engage the enlarged end portion of the proximal end of the drill string. The backup grips the enlarged end portion of the drill pipe at the proximal end of the drill string and prevents rotation of the drill string as the new drill pipe section is rotated onto the existing string. A spinner or a top drive may be used to rotate the drill pipe section to threadingly engage the drill string.

Under certain conditions, it is desirable to elevate the drill string when drill pipe sections are added. For example, in off-shore applications, ocean swells may move the platform vertically relative to the ocean floor. It is often desirable to not allow the weight of the drill string to rest on the drill bit. The drill pipe string thus must be retracted a sufficient distance to compensate for the rise and fall of the offshore platform. Also, it is often desirable to retract the drill pipe string a significant distance in very deep wells to keep the great weight of the drill string from resting on the drill bit.

Conventional backup tools engage the enlarged end portion of the drill pipe. As noted, when the drill string is elevated, the proximal end of the drill string may be several feet above the drilling platform floor. The elevated drill string end is not easily engaged by a conventional backup tool to prevent rotation of the drill string when a new pipe section is added to the string. Conventional backup tools must be elevated and time must be spent remotely guiding the tool to the enlarged end portion at the proximal end of the drill string. Such tools must be constructed to extend from a retracted position away from the centerline of the well hole. The tool must allow for vertical and horizontal adjustments in the location of the proximal end of the drill string.

This conventional procedure for securing a raised drill string is time consuming and requires relatively complex tools.

SUMMARY OF THE INVENTION

The present invention provides a relatively simple tool to secure the drill string as additional pipe sections are rotated onto the string. The principles of this invention may be applied in any application where it is desirable to secure a tubular member, such as a drill pipe without damaging the member.

The invention is an improved tool for securing a tubular member. The tool has a torque transferring member such as a lever that is connected to a head. The head has an aperture adapted for receiving a tubular member. Jaws are located within the aperture. At least one jaw is connected to an actuator. When the actuator is activated, the jaws engage the tubular member. The jaws have a tubular member engagement surface that extends longitudinally along the axis of the tubular member. The engagement surface has sufficient area such that the tubular member is not damaged when the actuator is activated and a torque is applied to the tubular member.

In one embodiment, inserts are detachably connected to the jaws and form the engagement surface. The inserts are softer than the tubular member. The inserts may be removed and replaced with inserts having the same radius as the tubular member.

In another embodiment, the tool is adapted for use on a drilling platform and is located below the drilling platform floor.

In another embodiment, a pressure regulating hydraulic cylinder is attached to a lever remote from the drill pipe body and the forces counteracting the rotation of the drill pipe body pass through the pressure regulating cylinder such that when the force through the pressure regulating cylinder increases, the pressure within the pressure regulating cylinder increases. The pressure regulating cylinder is in fluid communication with the cylinders attached to the jaw. As the pressure increases within the pressure regulating cylinder, the pressure to the cylinders connected to the jaw increases.

DESCRIPTION OF THE PRESENT INVENTION

Figure 1:
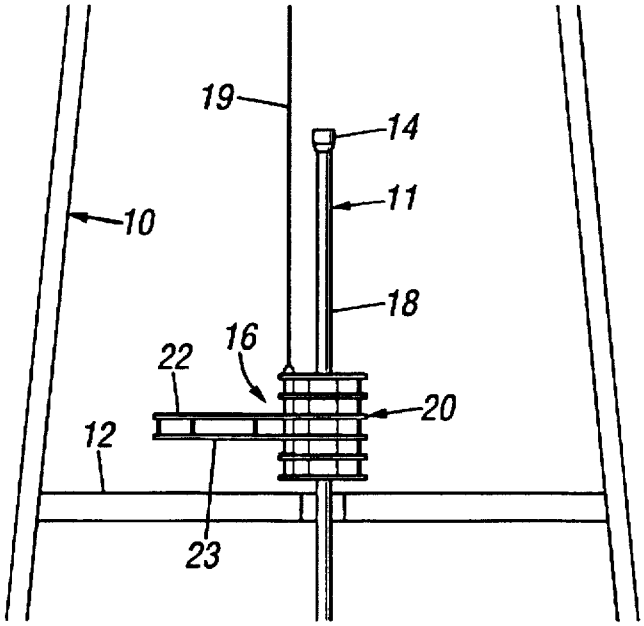
FIG. 1 is a side view of one embodiment of the present invention, engaging an elevated drill string.

FIG. 1 depicts a drill rig 10 with the proximal end of the drill string 11 extending above the drill rig platform floor 12. The enlarged end portion or box 14 of the drill pipe section forming the proximal end of the drill string is substantially above the drill rig platform floor 12. In this figure, a backup tool 16 is positioned to engage the drill pipe body 18 near the platform floor 12. The backup tool 16 is suspended above the platform floor 12 by a cable 19. The head 20 of the backup tool 16 engages the drill pipe body 18 and a first and second lever 22, 23 extend horizontally from the head 20. Anti-rotational torques experienced by the drill string 11 can be counteracted by engaging the head 20 to the drill pipe body 18 and securing the first and second levers 22, 23. The levers 22, 23 act as torque transfer members, transferring the torque applied to the drill pipe body 18 to a stationary member.

Figure 2:
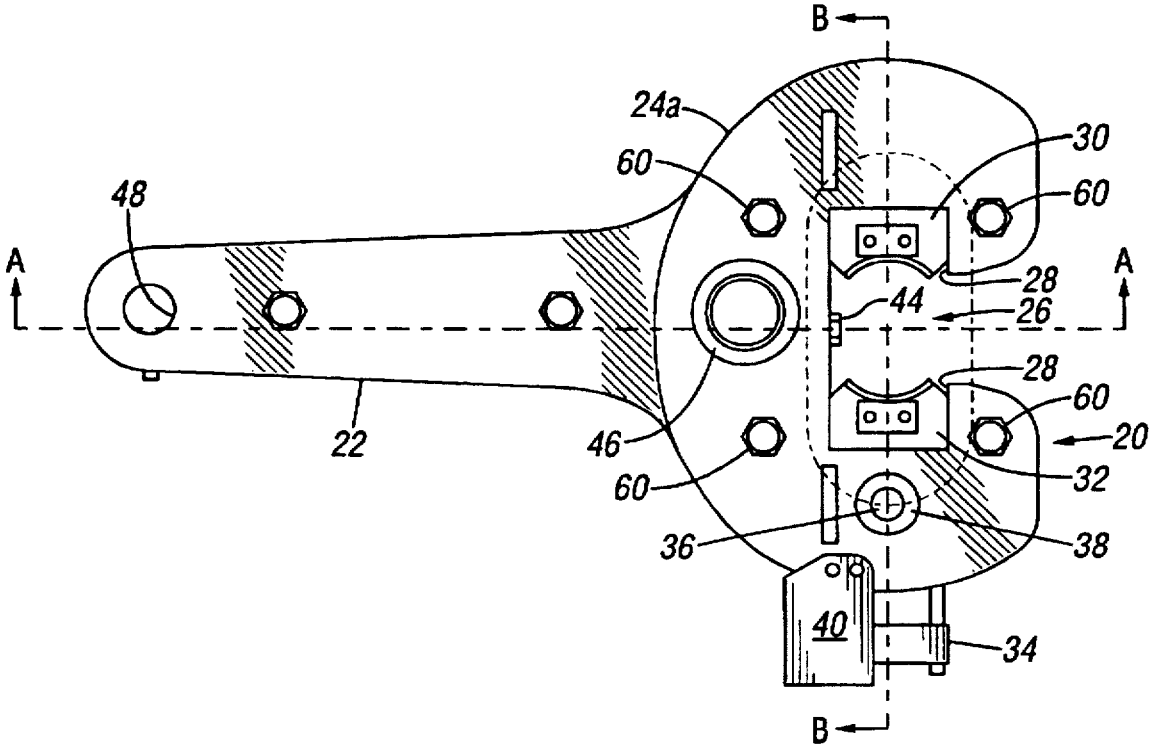
FIG. 2 is a top plan view of one embodiment of the present invention.
Figure 3:
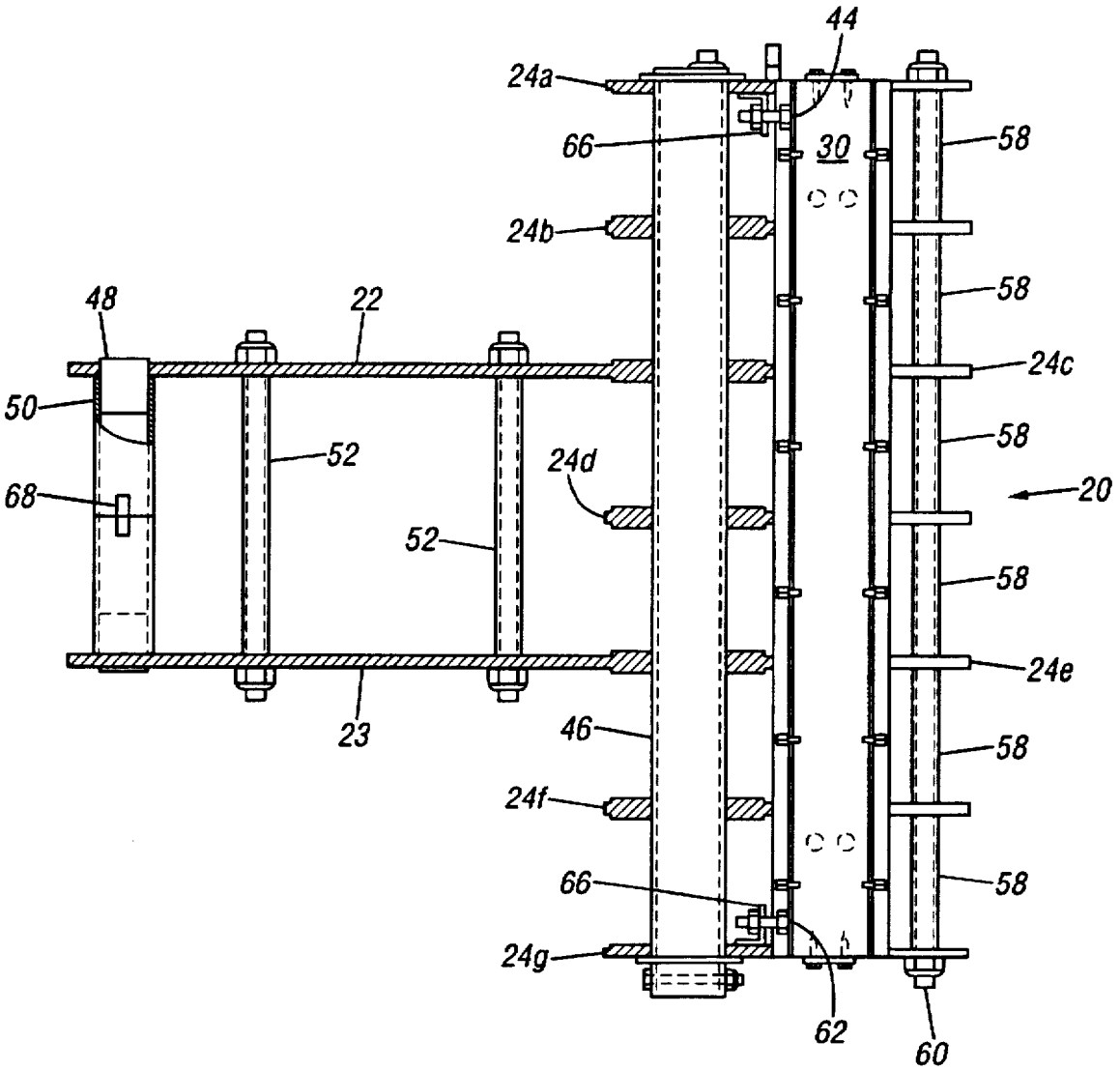
FIG. 3 is a partial-sectional view of one embodiment of the present invention.

FIG. 2 is another view of an embodiment of the present invention. In this view, a first end plate 24a of the tool head 20 is visible. As shown in FIG. 3, the tool head 20 has seven spaced plates 24*a–g* that uniformly distribute gripping pressure and anti-rotational forces to the drill pipe body 18.

Figure 4:
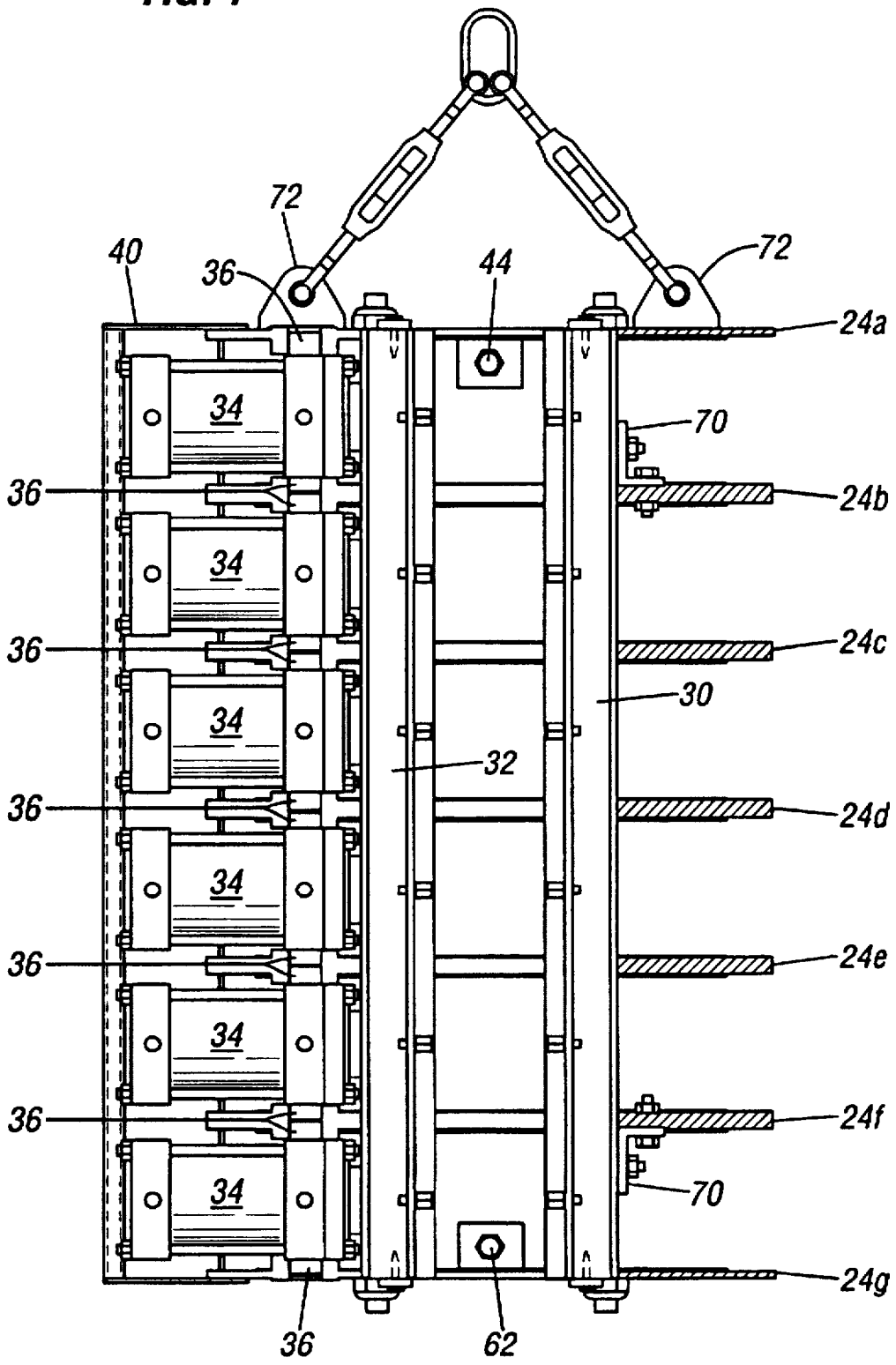
FIG. 4 is another partial-sectional view of one embodiment of the present invention.

As shown in FIG. 2, the plates 24*a–g* are C-shaped with an aperture 26 formed opposite the first and second levers 22, 23. The plates have two jaw grooves 28 that oppose each other across the aperture 26. A stationary jaw 30 and a moveable jaw 32 are slidably positioned in the jaw grooves 28. The stationary jaw 30 is attached to the plates. The moveable jaw 32 is attached to a plurality of hydraulic actuators 34 (only one hydraulic actuator is visible in FIG. 2; FIG. 4 depicts the plurality of hydraulic actuators).

The hydraulic actuators 34 are pivotly connected to the plates by pivot pins 36 which slidingly engage bushings 38 which are adjacent circular apertures in the plates. The moveable jaw 32 moves towards the stationary jaw 30 when pressurized fluid is applied to the hydraulic actuators 34 in one direction and away from the stationary jaw 30 when the direction of the fluid flow is reversed. The actuators 34 are connected (connections not shown) such that upon application of hydraulic pressure, the actuators 34 act together to apply pressure to the moveable jaw 32. The stationary jaw 30 is attached to the plates 24*a–g*. The jaws 31, 32 are sufficiently long that gripping pressures and anti-rotational forces are distributed over a large area of the pipe body 18 surface thereby avoiding damage to the pipe body 18. In one embodiment, the jaws 31, 32 are approximately 5 feet long.

A fitting guard 40 protects the hydraulic fittings that connect the plurality of hydraulic actuators 34. The fitting guard 40 extends from the first end plate 24*a* over a portion of the hydraulic actuators 34 and, as can be seen in FIG. 4, the fitting guard extends along the outward surface of the hydraulic actuators 34 and connects to the second end plate 24*g*.

A first adjustable stop 44 is located along the face of the aperture 26 between the stationary jaw 30 and the moveable jaw 32. The stop 44 abuts the drill pipe body 18 when the backup tool 16 engages the drill string 11. The stop 44 is adjusted to accurately position drill pipe bodies 18 of differing diameters between stationary jaw 30 and moveable jaw 32.

The torque pipe 46, as shown in FIG. 3, extends through all of the plates and acts to transfer torque from the first and second levers 22, 23 to the plates not attached to the first and second levers 22, 23.

The first and second levers 22, 23 extend from the tool head 20 away from the aperture 26 at the end of the levers 22, 23. Remote from the aperture 26 is a lever pipe 48. The lever pipe 48 distributes forces to the first and second levers 22, 23 to counteract rotational torques transferred to the drill pipe body 18. FIG. 3 shows that the lever pipe 48 is located within a lever pipe spacer 50. The lever pipe spacer 50 together with the lever spacers 52 help hold the first and second levers 22, 23 in the correct spacial orientation. The first and second levers 22, 23 are integral with a first and second lever plates 24*c*, 24*e* which form part of the tool head 20. In this embodiment, an intermediate plate 24*b* is disposed between the first end plate 24*a* and the first lever plate 24*c*. An intermediate plate 24*d* is disposed between the first lever plate 24*c* and the second lever plate 24*e*. Another intermediate plate 24*f* is disposed between the second lever plate 24*e* and the second end plate 24*g*.

A plurality of plate spacers 58 are interposed between the plates to hold them in their correct spacial orientation. A plate spacer bolt 60 is tightened to secure the plate spacers 57 in their appropriate position.

FIG. 3 shows the first stop 44 and second stop 62 being connected to a first stop member 64 and a second stop member 66. The first stop member 64 is connected to the first end plate 24*a*. The second stop member 66 is connected to the second end plate 24*g*.

The lever pipe 48 has an attachment member 68 for connecting the lever pipe 48 to the drill rig 10 to prevent the rotation of the raised backup tool 16 when torque is applied to the drill pipe 18.

FIG. 4 depicts a plurality of hydraulic actuators 34 previously noted. The actuators 34 are pivotly connected to the plates. A pin 36 extends from the hydraulic actuators 34 and pivotly engages a bushing 38 (not shown) which is connected to the plates adjacent the actuator 34. For example, the actuator 34 disposed between the first end plate 24*a* and the adjacent intermediate plate 24*b* is pivotally connected to the first end plate 24*a* and the adjacent intermediate plate 24*b*. The actuators 34 are also connected to the-moveable jaw 32.

The stationary jaw 30 is connected to jaw flanges 70 that are connected to the intermediate plates 24*b*, 24*f* adjacent the first and second plates 24*a*, 24*g*.

Two tool support flanges 72 are connected to the first end plate 24*a*. The tool support flanges 72 engage turnbuckles 74 which in turn are connected to a master link 76. The master link 76 can be attached to a tool support cable 19 as depicted in FIG. 1.

Figure 5:
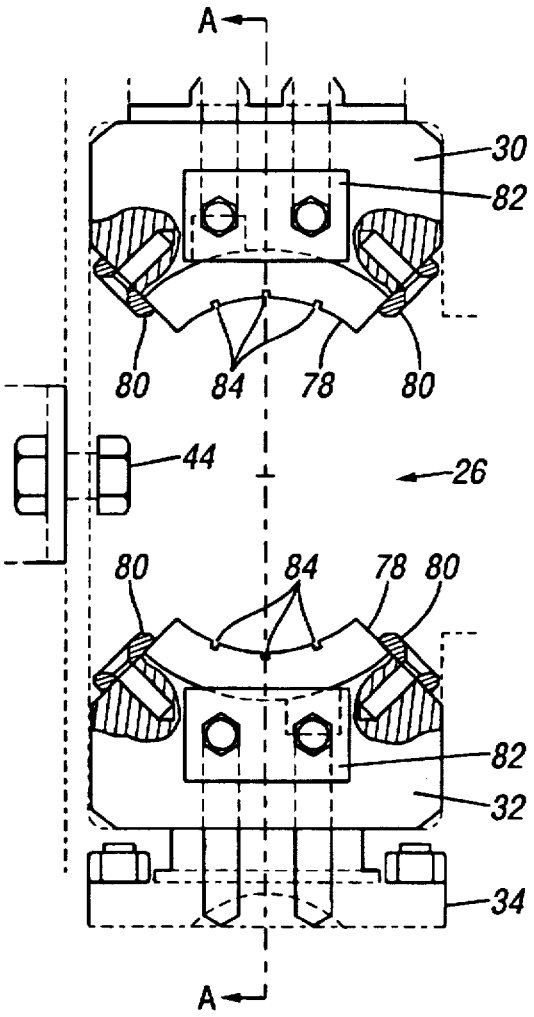
FIG. 5 is an enlarged view of one aspect of the present invention.

FIG. 5 depicts the movable jaw 32 and the stationary jaw 30 showing additional detail. Each jaw 30, 32 is adapted to receive an insert 78. In this embodiment, the inserts 78 provide an engagement surface that contacts approximately 45% of the drill pipe body 18 surface. The inserts 78 are connected to jaws 30,32 with sidekeepers 80 and endkeepers 82. The sidekeepers 80 are attached to the jaws 30, 32 and extend over the edges of the insert 78 to hold the insert securely against the jaws 30, 32. The endkeepers 82 are bolted to the jaws 30, 32 and extend over the end of the insert 78 preventing it from moving along its longitudinal axis relative to the jaws 30, 32. Insert grooves 84 run longitudinally along the inserts 78. The insert grooves 84 provide an escape path for fluids on the drill pipe body 18 surface, such as drilling mud, when the backup tool 16 engages the drill string 11. To reduce the likelihood of damage to the drill pipe body 18, the inserts 78 may be made of a material that is softer than the material used in the drill pipe body 18. In this embodiment, the drill pipe body 18 is steel and the inserts 78 are made of aluminum. The inserts 78 are interchangeable so that inserts 78 have differing radii can be put in the jaws 30,32 to accommodate pipe with different diameters. In one embodiment, the insert sizes vary to accommodate drill pipe bodies 18 having a diameter from 3½ to 6⅝ inches.

Figure 6:
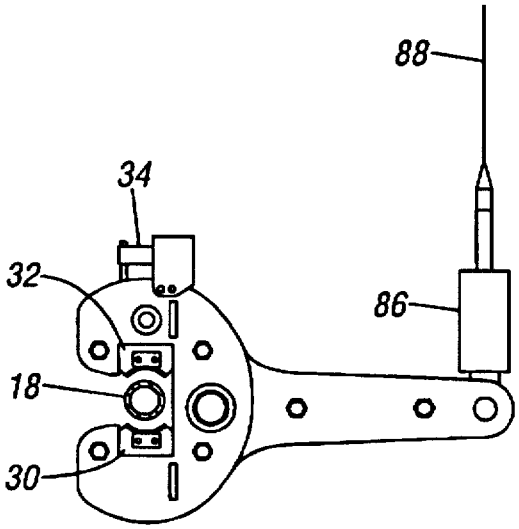
FIG. 6 is a top plan view depicting another aspect of the present invention.

FIG. 6 shows another feature of the present invention. A drill pipe body 18 is disposed between the jaws 30,32. A pressure regulating cylinder 86 is attached to the lever pipe attachment member 68. An anti-rotation cable 88 is connected to the drill rig 10 to prevent rotation of the raised backup tool when a clockwise torque is applied to the drill pipe body 18. A valve (not shown) is opened and pressurized fluid at a predetermined pressure enters the hydraulic actuators 34 and the pressure regulating cylinder 86. The pressurized fluid moves the moveable jaw 32 to engage the pipe body 18 which is then forced against the stationary jaw 30. The pressurized fluid also retracts the pressure regulating cylinder 86.

As the clockwise torque is increased on the drill pipe body 18, the tension in the anti-rotation cable 88 and pressure regulating cylinder 86 is increased which results in an increased pressure within the pressure regulating cylinder 86. This increased pressure is communicated to the hydraulic actuators 34 attached to the movable jaw 32. Thus, as the force resisting rotation increases, the pressure within the pressure regulating cylinder 86 increases, with the result that increased pressure is communicated to the hydraulic actuators 34 connected to the movable jaw 32. Thus, as the torque on the drill pipe body 18 is increased above a predetermined level, the gripping pressure is correspondingly increased.

A pressure relief valve can be added to the system to prevent application of pressures above a predetermined limit to the drill pipe body 18.

The invention is not limited to the specific embodiments disclosed. It will be readily recognized by those skilled in the art that the inventive concepts disclosed can be expressed in numerous ways. For example, jaws 30, 32 can be rotated 90° relative to the axis of the disclosed backup tool 16. Such a modified tool could be pivotally attached to a stand mounted to the platform floor 12. In another example, the hydraulic actuators 34 could be connected to the jaws 30, 32 through pivot members. The pivot members could engage a pivot in scissor-like fashion. Since exact alignment with the enlarged end portion 14 of a drill pipe is not required, one of ordinary skill would also recognize that a backup tool incorporating the advantages of this invention could be remotely operated below the platform floor 12.

What is claimed is:

1. A tubular member gripping tool comprising:

a torque transferring member;

a head connected to said torque transferring member, said head having an aperture adapted to receive a segment of a tubular member;

an actuator connected to said head;

a plurality of tubular member engagement surfaces disposed within said aperture, one of said tubular member engagement surfaces connected to said actuator, said tubular member engagement surfaces having sufficient area to distribute a gripping and torsional force to said tubular member without damaging said tubular member;

said actuator is a hydraulic cylinder; and a pressure regulating hydraulic cylinder, said pressure regulating cylinder being attached to said torque transferring member remote from said head, said pressure regulating cylinder being in fluid communication with said actuator such that the fluid pressure within said actuator increases when the fluid pressure within the regulating cylinder increases.

2. A backup tool comprising:

a lever;

a head connected to said lever, said head having an aperture, said aperture adapted for receiving a portion of a drill pipe body, said aperture having a plurality of jaw grooves;

a plurality of jaws disposed within said jaw grooves, one of said jaws being a moveable jaw, said moveable jaw being in sliding engagement with one of said jaw grooves;

an actuator, said actuator being connected to said moveable jaw, said actuator being pivotally connected to said head;

a plurality of pipe engagement surfaces, said pipe engagement surfaces connected to said jaws, said Pipe engagement surfaces having sufficient area to distribute a gripping and torsional load to said drill pipe body to counteract rotational forces applied to a drill string when a section of drill pipe threadingly engages said drill string without damaging said drill pipe body;

said actuator is an hydraulic cylinder; and a hydraulic pressure regulating cylinder, said pressure regulating cylinder being attached to said lever remote from said head, said hydraulic pressure regulating cylinder being in fluid communication with said actuator such that a fluid pressure increase within said pressure regulating cylinder creates a pressure increase in said actuator.

3. A method for preventing rotation of a drill string without damaging the drill string, comprising the steps of:

engaging a drill pipe body at the Proximal end of said drill string with a plurality of jaws, said jaws contacting said drill pipe body over a sufficiently large area that gripping and torsional forces can be transferred without damaging said drill pipe body;

connecting said jaws to a member capable of resisting a rotational force applied to said drill string; and transferring said rotational force from said jaws through a pressure regulating cylinder, said pressure regulating cylinder being in fluid communication with an hydraulic actuator, said hydraulic actuator moving said jaws into engagement with said drill pipe body and creating pressure securing said jaws against said drill pipe body such that when said rotational forces increase, said pressure applied by said actuator increases.

* * * * *